US007063622B1

(12) United States Patent
Luoma

(10) Patent No.: US 7,063,622 B1
(45) Date of Patent: Jun. 20, 2006

(54) BOWLING LANE SYSTEM

(76) Inventor: Douglas J. Luoma, 241 Cherokee Rd. #6, Beaver Dam, WI (US) 53916

( * ) Notice: Subject to any disclaimer, the term of this patent is extended or adjusted under 35 U.S.C. 154(b) by 0 days.

(21) Appl. No.: 11/019,775

(22) Filed: Dec. 23, 2004

(51) Int. Cl.
*A63D 1/04* (2006.01)

(52) U.S. Cl. ..... 473/54; 473/115; 473/107; 473/109

(58) Field of Classification Search ..... 473/54, 473/55, 56, 115, 106, 107, 109
See application file for complete search history.

(56) References Cited

U.S. PATENT DOCUMENTS 1,708,101 A * 4/1929 Kornsweet ..... 273/118 A
1,899,442 A 2/1933 Hess
1,919,094 A * 7/1933 Cuchran ..... 473/107
3,046,012 A * 7/1962 Marx ..... 473/109
3,111,315 A 11/1963 Vermeulen
3,371,931 A 3/1968 Oberg
3,392,975 A * 7/1968 Winkleman ..... 473/109
3,662,729 A 5/1972 Henderson
3,841,632 A * 10/1974 Schwartz ..... 473/109
3,951,408 A * 4/1976 Reiner et al. ..... 473/107
5,183,261 A 2/1993 Nobi
D349,936 S 8/1994 Rochefort
5,415,591 A * 5/1995 Beene ..... 473/113
5,820,474 A 10/1998 Delaney et al.
5,830,073 A * 11/1998 Voss ..... 473/54
6,283,872 B1 * 9/2001 Lichodziejewski et al. ... 473/54

* cited by examiner

*Primary Examiner*—William M. Pierce

(57) ABSTRACT

A bowling lane system for enhancing the entertainment when bowling. The bowling lane system includes a lane member having a pair of gutter portions extending a length of the lane member whereby the gutter portion are positioned on opposing sides of the lane member. The top surface of the lane member is designed for supporting a bowling ball and pins. The lane member has a deflection assembly. The ball deflection assembly is designed for deflecting the bowling ball towards the pins when the bowling ball is rolled along a top surface of the lane member.

12 Claims, 8 Drawing Sheets

BOWLING LANE SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a bowling lane system and, more particularly, to a bowling lane system for providing a novel method of bowling.

2. Prior Art

The use of bowling lanes and bowling lane systems is well known in the prior art. Such bowling lanes generally consist of a paneled strip, 60 feet in length, with ten pins set up at the far end. A bowler rolls a bowling ball from the other end in an attempt to knock over as many pins as possible, preferably knocking all ten over with their first ball.

Although some individuals have found this sport to be enjoyable, a majority of people feel that it is rather mundane in nature. Especially over the last few years, bowling alleys have suffered customer and monetary losses to institutions such as game parks and arcades that offer a more stimulating challenge.

Furthermore, most bowling lanes offer no accommodation to handicapped individuals who may have trouble throwing the heavy balls used in bowling. Yet again the bowling alley owners are loosing out on a possible clientele source. Although gutter blockers have been employed, these seem to remove part of the challenge of the game and tend not to be used by older individuals.

Accordingly, a need remains for a bowling lane system in order to overcome the above-noted shortcomings. The present invention satisfies such a need by providing a bowling lane system that is novel in design, easy to use, provides more fun challenges to bowlers, and increases revenue for bowling alleys. Such a bowling system allows bowlers at all levels to experience the sport in a new way. Unique challenges are set forth that draws new attention to the sport as well and thus increases the amount of people interested therein.

BRIEF SUMMARY OF THE INVENTION

In view of the foregoing background, it is therefore an object of the present invention to provide a bowling lane system. These and other objects, features, and advantages of the invention are provided by a bowling lane system for providing a novel method of bowling.

The bowling lane system includes a lane member that has a top surface and a pair of gutter portions extending along a length of the lane member such that the gutter portions are positioned on opposing sides of the lane member. Such a top surface of the lane member is adapted for supporting a bowling ball and pins.

The lane member has a ball deflection assembly. Such a ball deflection assembly is adapted for advantageously deflecting the bowling ball towards the pins when the bowling ball is rolled along a top surface of the lane member. The ball deflection assembly preferably includes a plurality of deflection members. Such deflection members are positioned in a spaced relationship across a width of the lane member. Each of the deflection members are selectively positionable in a raised position defined by an associated one of the deflection members angling upwardly from the top surface of the lane member. The deflection members of the ball deflection assembly may be positioned in a substantially triangular formation. Such deflection members have a pair of apex members wherein each of the apex members is positioned farthest from the gutter portions and is positioned closest to the pins.

Such deflection members are adapted for conveniently redirecting the path of the bowling ball when an associated one of the deflection members is in the raised position and is struck by the bowling ball propelled down the lane member. Each of the deflection members are further selectively positionable in a lowered position defined by the associated one of the deflection members being level with the top surface of the lane member and adapted for effectively permitting the bowling ball to pass unimpeded.

The ball deflecting assembly may further include a control assembly. Such a control assembly is operationally coupled to the ramp members such that the control assembly selectively raises at least one of the ramp members into the raised position for redirecting the path of the bowling ball.

The ball deflection assembly preferably further includes a plurality of motor assemblies. Each of the motor assemblies is operationally coupled between one of the deflection members and the control assembly such that each of the motor assemblies actuates the associated one of the deflection members between the raised position and the lowered position when the control assembly is actuated by the user. The ball deflection assembly may also further include a plurality of accelerating members. Each of the accelerating members is coupled to one of the deflection members for advantageously accelerating the raising of the associated one of the deflection members into the raised position when the associated one of the motor assemblies is actuated by the control assembly.

The ball deflection assembly preferably includes a time delay assembly. Such a time delay assembly is operationally coupled between the control assembly and the motor assemblies for actuating each of the motor assemblies into the lowered position after a predetermined amount of time has elapsed since the associated one of the deflection members was raised into the raised position.

In an alternate embodiment of the present invention the ball deflection assembly further includes a raised portion and a ramp portion. Such a raised portion is positioned on the top surface of the lane member such that an upper surface of the raised portion is positioned above the top surface of the lane member. The upper surface of the raised portion is conveniently adapted for supporting the pins. The ramp portion has an angled face extending from the top surface of the lane member to the upper surface of the raised portion such that the angled face is adapted for effectively vaulting the bowling ball into the pins positioned on the upper surface of the raised portion.

Such a ball deflection assembly preferably further includes a ramp member. The ramp member is selectively positionable in a raised position defined by the ramp member angling upwardly from the top surface of the lane member and is adapted for vaulting the bowling ball into the pins when the ramp is in the raised position and is struck by the bowling ball propelled down the lane member. Such a ramp member is selectively positionable in a lowered position defined by the ramp member being level with the top surface of the lane member for advantageously permitting the bowling ball to pass unimpeded.

In yet another embodiment the bowling lane system further includes a propulsion mechanism that is adapted for engaging the bowling ball such that the propulsion mechanism propels the bowling ball along the length of the lane member towards the pins when the propulsion mechanism is actuated. Such a propulsion mechanism is selectively positioned on a top surface of the lane member along a desired path.

The propulsion mechanism preferably has a housing and a saddle member. Such a saddle member is positionable in the housing and has a recessed area such that the recessed area is adapted for receiving the bowling ball therein. The saddle member of the propulsion mechanism preferably has a handle portion extending through a slot in a top wall of the housing. Such a saddle member is adapted being gripped in the hand of the bowler such that the handle portion permits the bowler to draw the saddle member into a cocked position prior to propelling the bowling ball down the lane member. At least one biasing member is positioned between the housing and the saddle member such that the biasing member is adapted for propelling the bowling ball out of an open end of the housing. The housing of the propulsion mechanism may further have a foot support portion. Such a foot support portion extends from a closed end of the housing opposite the open end of the housing. The foot support portion is adapted for receiving a foot of the bowler for advantageously inhibiting sliding of the housing when the bowling ball is propelled by the saddle member.

The propulsion mechanism preferably further has a latching member. Such a latching member extends through the housing and is pivotally coupled to the housing such that the latching member selectively engages the saddle member in the cocked position for selectively preventing the bowling ball from being propelled down the lane member. The latching member is pivotal for conveniently releasing the saddle member when the bowling ball is to be propelled down the lane. Such a latching member of the propulsion mechanism preferably has a pawl. Such a pawl is positioned at an end of the latching member such that the pawl selectively engages a locking channel of the saddle member when the saddle member is in the cocked position.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
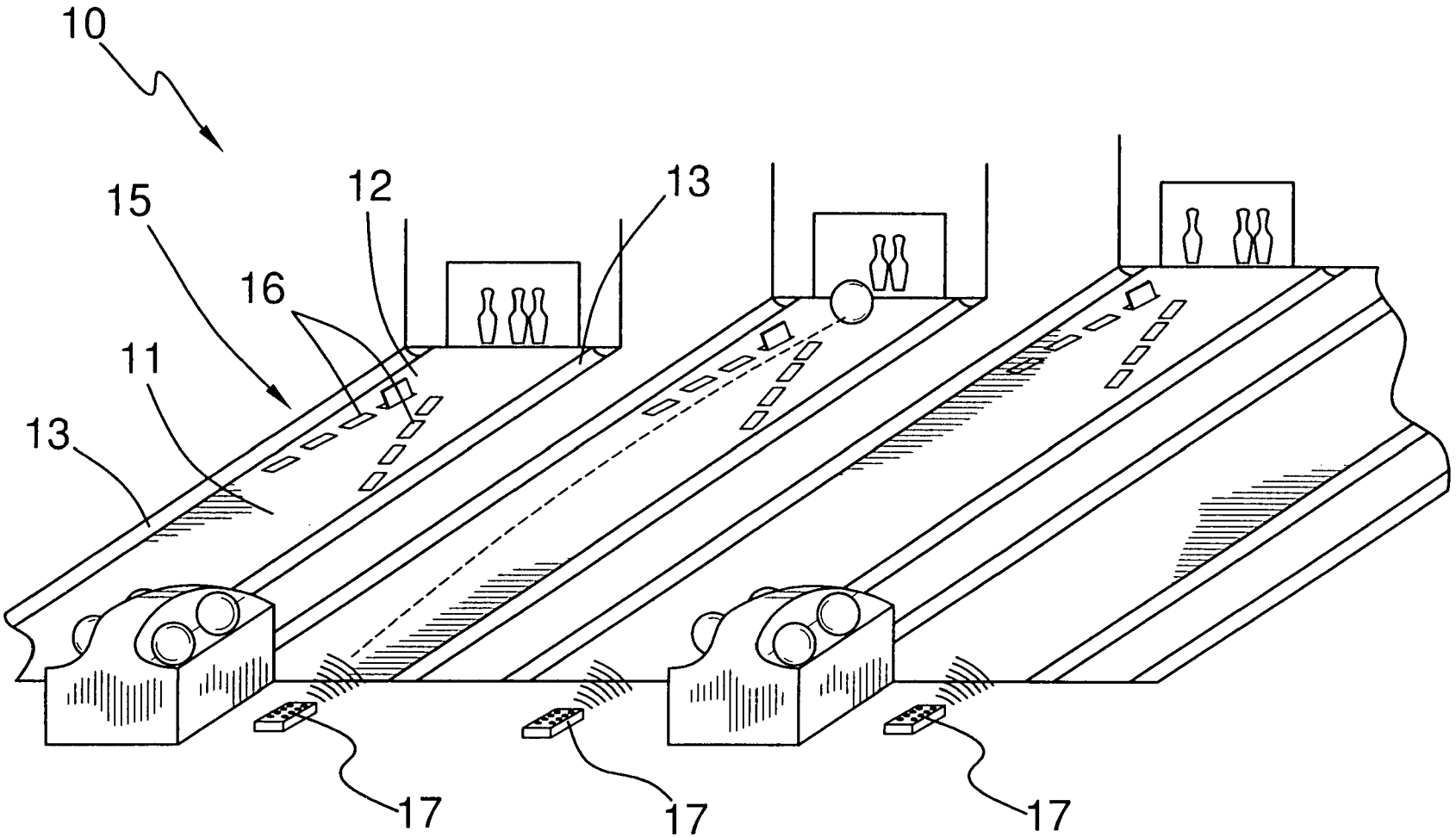
FIG. 1 is a perspective view showing a bowling lane system, in accordance with the present invention.
Figure 2:
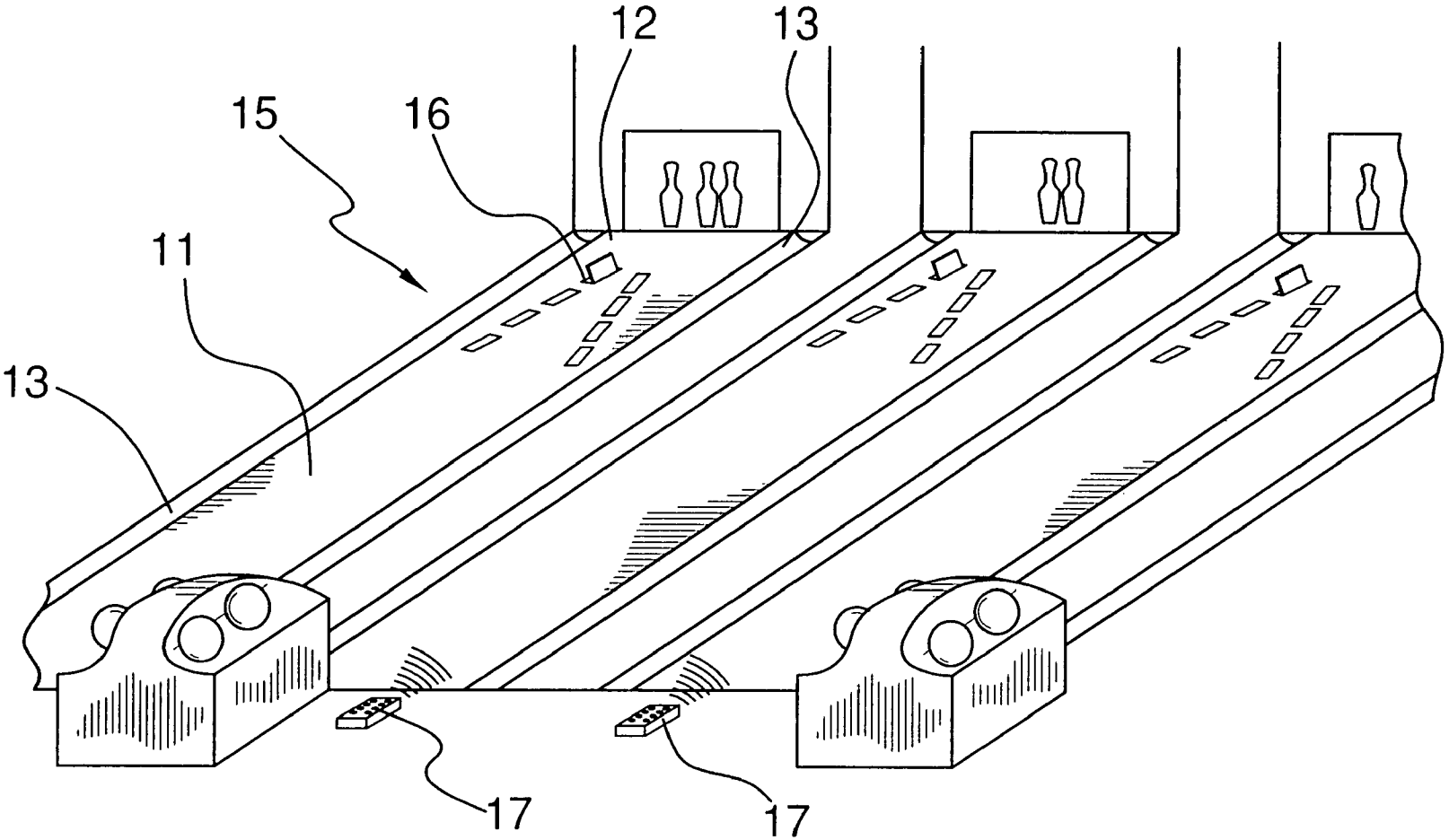
FIG. 2 is a perspective view of the system shown in FIG. 1.

The present invention will now be described more fully hereinafter with reference to the accompanying drawings, in which preferred embodiments of the invention are shown. This invention may, however, be embodied in many different forms and should not be construed as limited to the embodiment set forth herein. Rather, these embodiments are provided so that this application will be thorough and complete, and will fully convey the true scope of the invention to those skilled in the art. Like numbers refer to like elements throughout the figures and prime and double prime numbers refer to like elements in alternate embodiments.

The assembly of this invention is referred to generally in FIGS. 1–8 by the reference numeral 10 and is intended to provide a bowling lane system. It should be understood that the system 10 may be used for bowling in many different types of settings and should not be limited to only recreational bowling.

Referring to FIGS. 1 through 8, the bowling lane system 10 generally includes a lane member 11 having a top surface 12. The lane member 11 has a pair of gutter portions 13 extending a length of the lane member 11 whereby the gutter portions 13 are positioned on opposing sides of the lane member 11. The top surface 12 of the lane member 11 is designated for supporting a bowling ball and pins.

The lane member 11 may further include a ball deflection assembly 15. The ball deflection assembly 15 is designed for deflecting the bowling ball towards the pins when the bowling ball is rolled along a top surface 12 of the lane member 11. The ball deflection assembly has a plurality of deflection members 16. The deflection members 16 are positioned in a spaced relationship across a width of the lane member 11. Each of the deflection members 16 is selectively positionable in a raised position defined by the associated one of the deflection members 16 angling upwardly from the top surface 12 of the lane member 11.

Each of the deflection members 16 is designed for redirecting the path of the bowling ball when the associated one of the deflection members 16 is in the raised position and is struck by the bowling ball propelled down the lane member 11. Each of the deflection members 16 is selectively positionable in a lowered position defined by the associated one of the deflection members 16 being level with the top surface 12 of the lane member 11 to thereby permit the bowling ball to pass unimpeded. Of course, the deflection members 16 of the ball deflection assembly 15 may have a variety of conventional shapes, as well known to a person of ordinary skill in the art.

The ball deflection assembly 15 further has a control assembly 17. The control assembly 17 is operationally coupled to the ramp members 44 whereby control assembly 17 selectively raises at least one of the ramp members 44 into the raised position for redirecting the path of the bowling ball. The control assembly 17 may be remote of the ball deflection assembly and worn or carried by the bowler to actuate the deflection members 16 as desired by the bowler.

The control assembly 17 preferably operates on a unique low radio frequency to inhibit inadvertent activation of deflection members 16 of any other ball deflection assembly in the proximate area. Of course, the control assembly 17 may also operate via infrared signals, optical signals and other well known wireless telecommunication signals available in the industry, without departing from the true scope of the present invention. Alternately, the control assembly 17 may be positioned on the scoring station where the control assembly 17 may be actuated by a partner of the bowler to control the path of the bowling ball.

The deflection members 16 of the ball deflection assembly 15 are preferably positioned in a substantially triangular formation wherein each deflection member 16 has a pair of apex members. The apex members are positioned farthest from the gutter portions 13 and are positioned closest to the pins.

The ball deflection assembly 15 includes a plurality of motor assemblies 18. Each of the motor assemblies 18 is operationally coupled between one of the deflection members 16 and control assembly 17 whereby each of the motor assemblies 18 actuates an associated one of the deflection members 16 between the raised position and the lowered position when the control assembly 17 is actuated by the user.

The ball deflection assembly 15 may further include a plurality of accelerating members 19, such as springs. Each of the accelerating members 19 is coupled to one of the deflection members 16. Each of the accelerating members 19 initiates the raising of the associated one of the deflection members 16 into the raised position when the associated one of the motor assemblies 18 is actuated by the control assembly 17.

The ball deflection assembly may further include a time delay assembly 20. The time delay assembly 20 is operationally coupled between the control assembly 17 and the motor assemblies 18. The time delay assembly 20 actuates each of the motor assemblies 18 to lower the associated one of the deflection assemblies into the lowered position after a predetermined amount of time has elapsed since the associated one of the deflection members 16 was raised into the raised position.

A propulsion mechanism 22 may also be provided for engaging the bowling ball whereby the propulsion mechanism 22 displaces the bowling ball along the length of the lane member 11 towards the pins when the mechanism is actuated during game play. The propulsion mechanism 22 is selectively positioned on a top surface 12 of the lane member 11 to allow the bowling ball to be directed along the lane member 11 along a desired path.

The propulsion mechanism 22 has a housing 23 and a saddle member 24. The saddle member 24 is positioned in the housing 23 and has a recessed area 25 whereby the recessed area 25 is designed for receiving the bowling ball. At least one biasing member 26 is positioned between the housing 23 and the saddle member 24 whereby the biasing member 26 is designed for propelling the bowling ball out of an open end 32 of the housing 23.

The saddle member 24 of the propulsion mechanism 22 has a handle portion 27. The handle portion 27 of the saddle member 24 extends through a slot 28 in a top wall 29 of the housing 23 such that the handle member 27 can be gripped in the hand of the bowler and permit the bowler to draw the saddle member 24 into a cocked position prior to propelling the bowling ball down the lane member 11.

The propulsion mechanism 22 further has a latching member 30. The latching member 30 extends through the housing 23 and is pivotally coupled to the housing 23 wherein the latching member 30 selectively engages the saddle member 24 in the cocked position for selectively preventing the bowling ball from being propelled down the lane member 11. The latching member 30 is pivotal for releasing the saddle member 24 when the bowling ball is to be propelled down the lane member 11.

The latching member 30 of the propulsion mechanism 22 further has a pawl. The pawl 31 is positioned at an end 32 of the latching member 30 wherein the pawl 31 selectively engages a locking channel 33 of the saddle member 24 when the saddle member 24 is in the cocked position.

The housing 23 of the propulsion mechanism 22 may further have a foot support portion 34. The foot support portion 34 extends from a closed end 32 of the housing 23 opposite the open end 32 of the housing 23. The foot support portion 34 is designed for receiving a foot of the bowler for inhibiting sliding of the housing 23 when the bowling ball is propelled by the saddle member 24.

Figure 3:
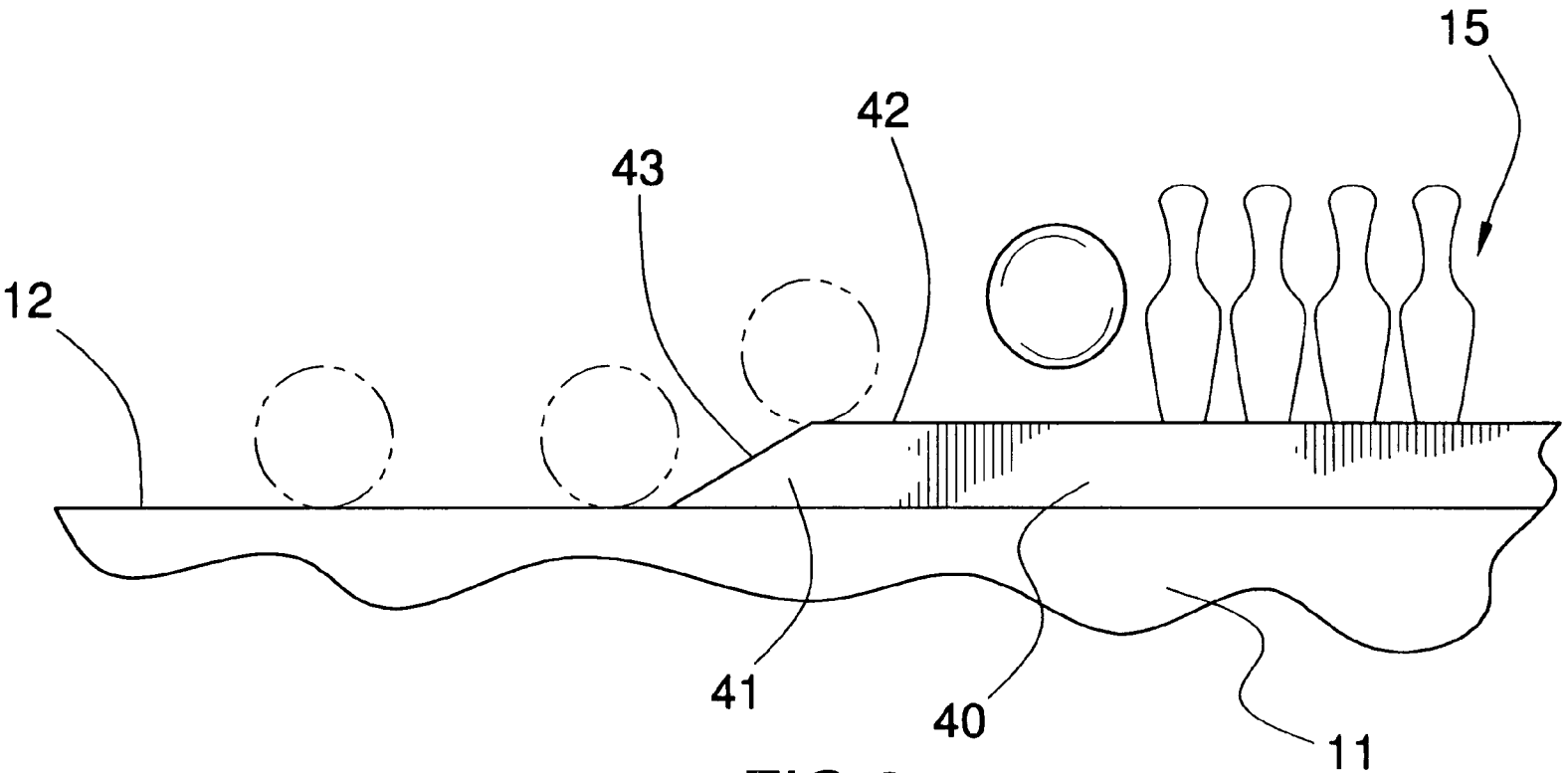
FIG. 3 is a side elevational view showing an alternate embodiment of the present invention.

In a preferred embodiment, as shown in FIG. 3, the ball deflection assembly has a raised portion 40 and a ramp portion 41. The raised portion 40 is positioned on the top surface 12 of the lane member 11. The upper surface 42 of the raised portion 40 is designed for supporting the pins. The ramp portion 41 has an angled face 43 extending from the top surface 12 of the lane member 11 to the upper surface 42 of the raised portion 40 wherein the angled face 43 is designed for vaulting the bowling ball into the pins positioned on the upper surface 42 of the raised portion 40.

Figure 4:
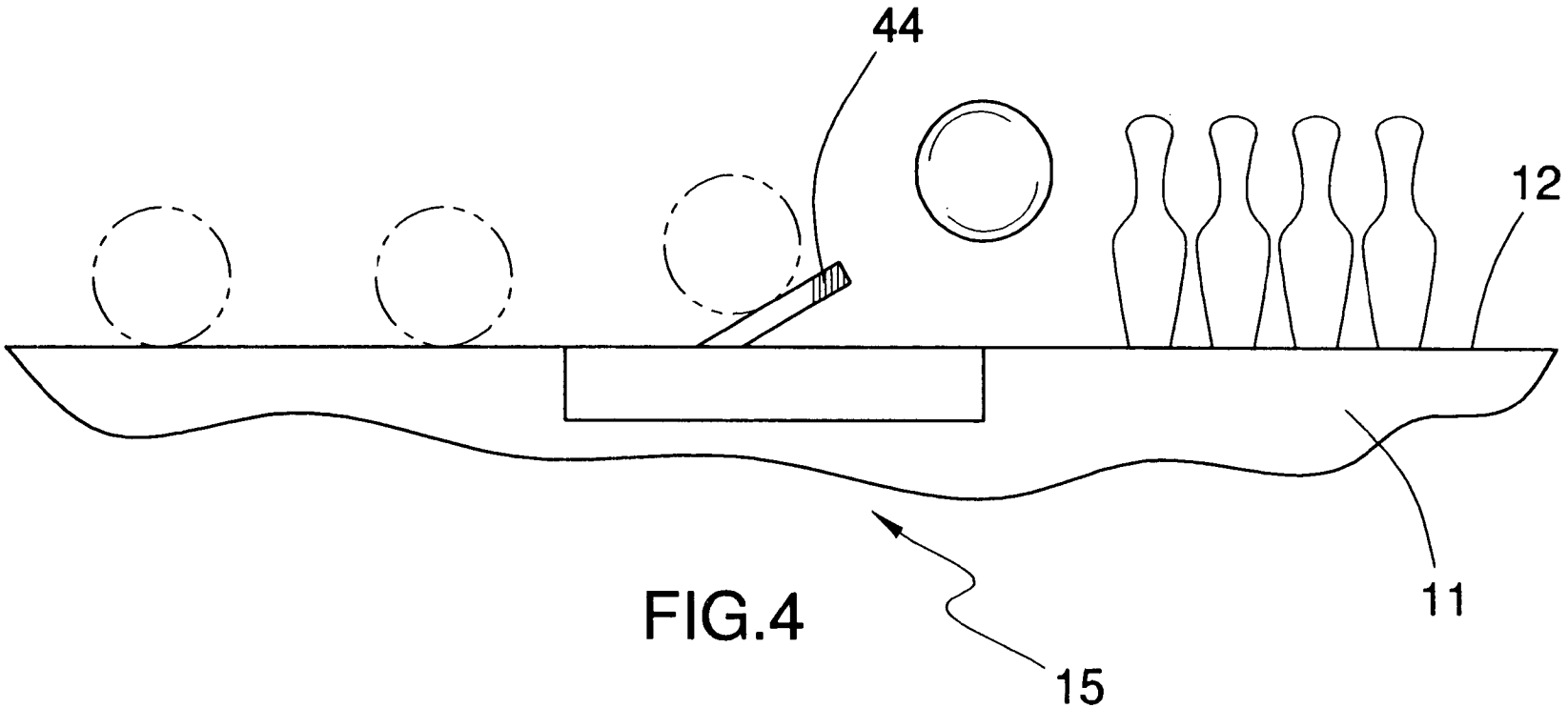
FIG. 4 is a side elevational view showing yet another embodiment of the present invention.
Figure 5:
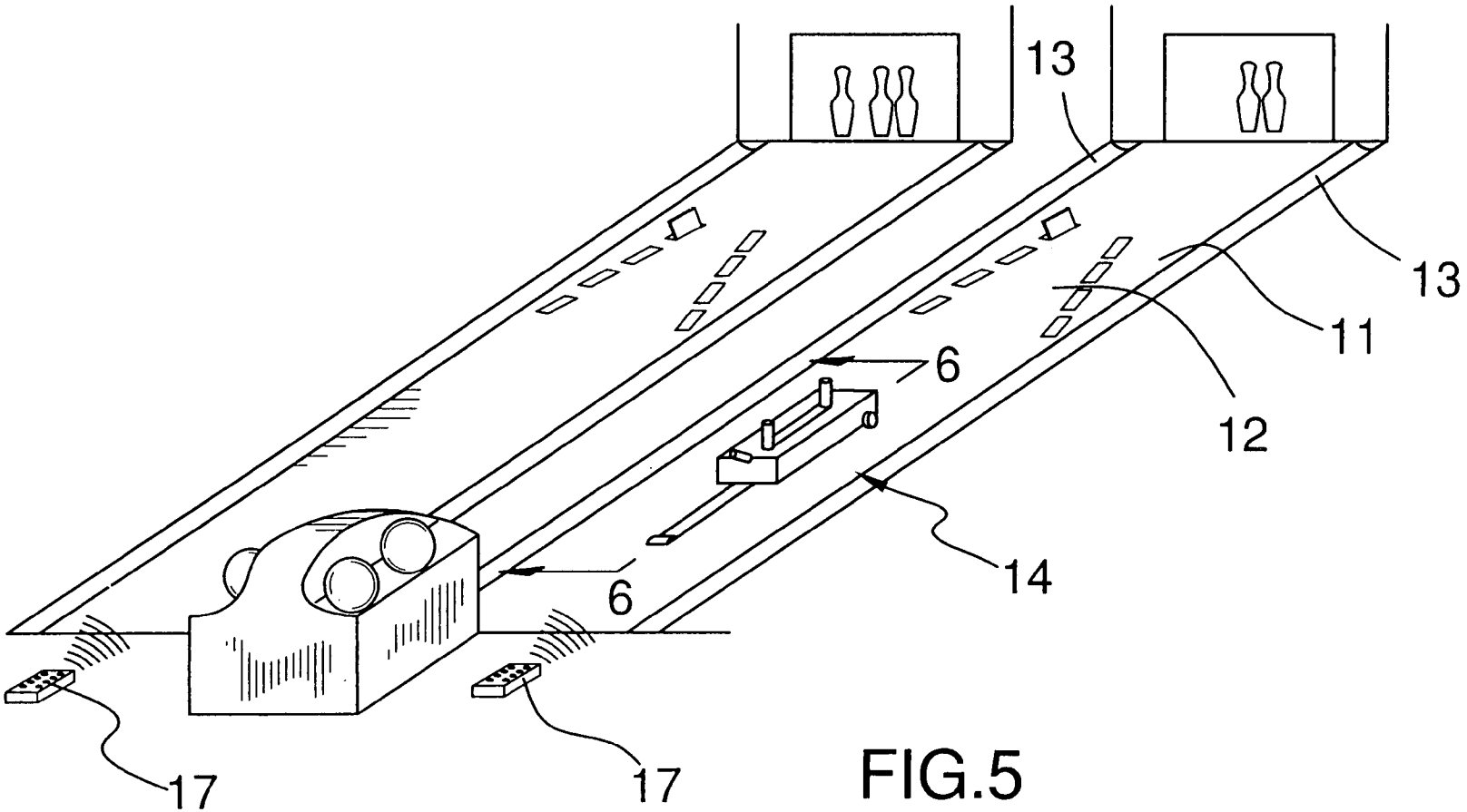
FIG. 5 is a perspective view of the present invention showing a propelling mechanism for displacing bowling balls.
Figure 6:
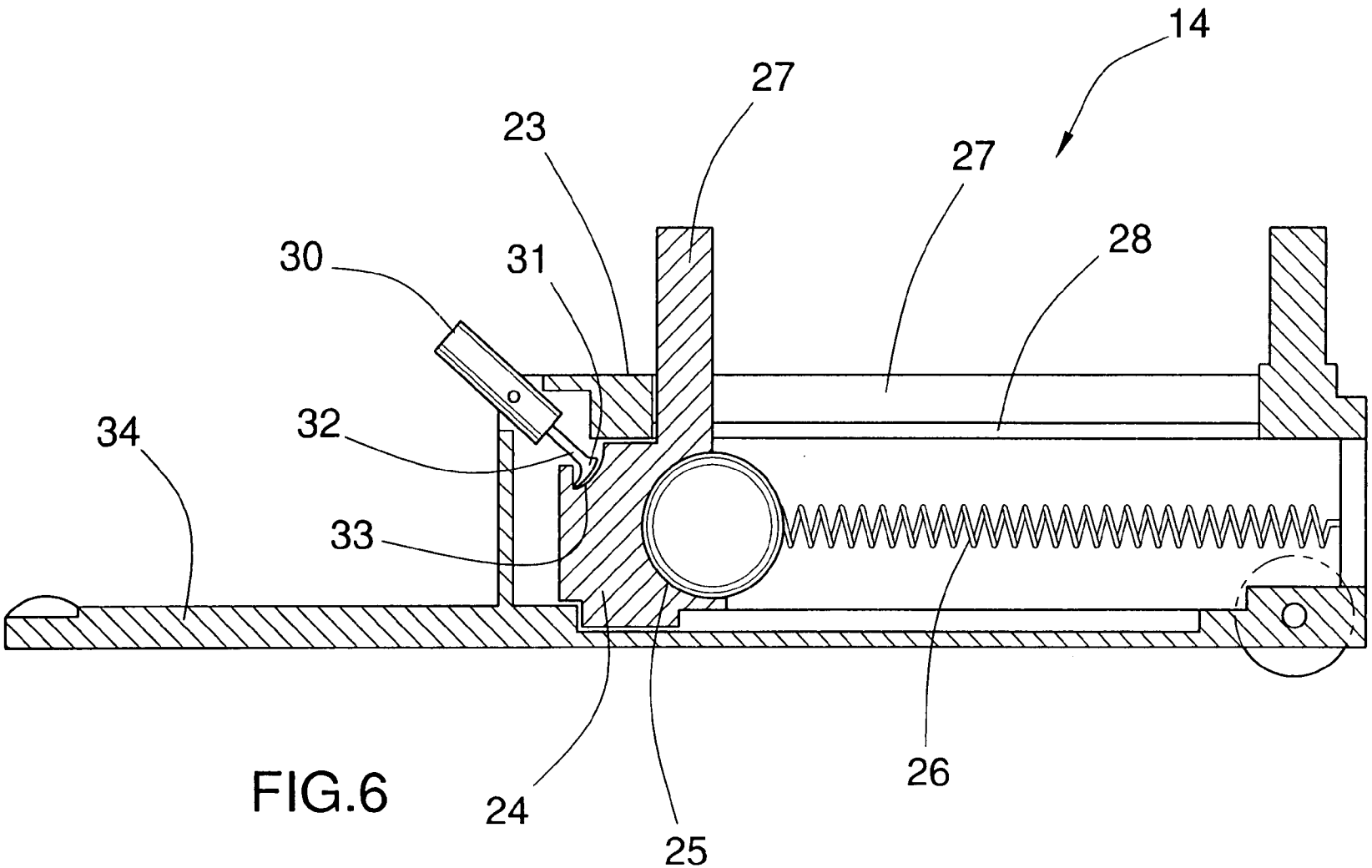
FIG. 6 is a cross-sectional view of the propelling mechanism shown in FIG. 5, taken along line 6—6.
Figure 7:
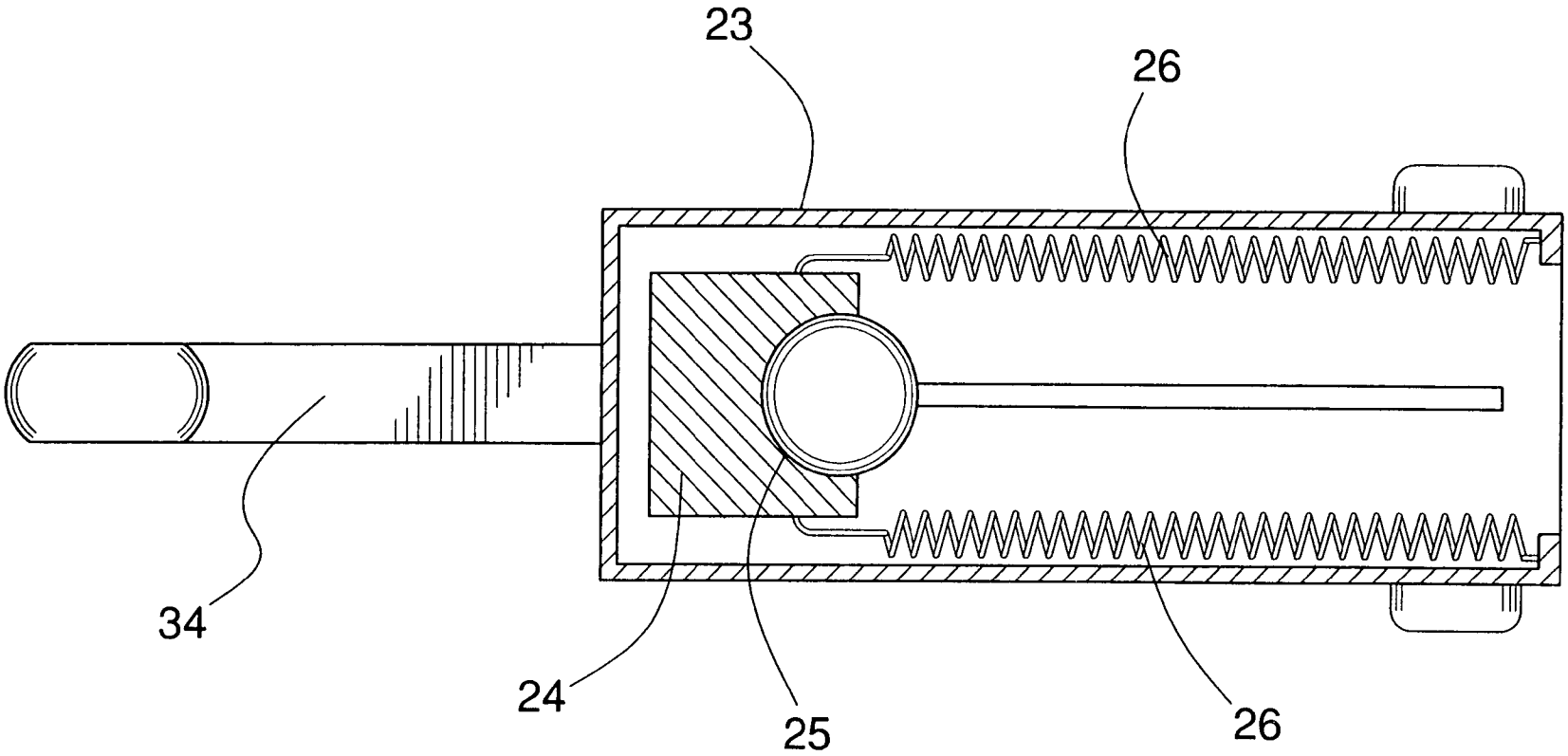
FIG. 7 is top plan cross-sectional view of the propelling mechanism shown in FIGS. 5 and 6.
Figure 8:
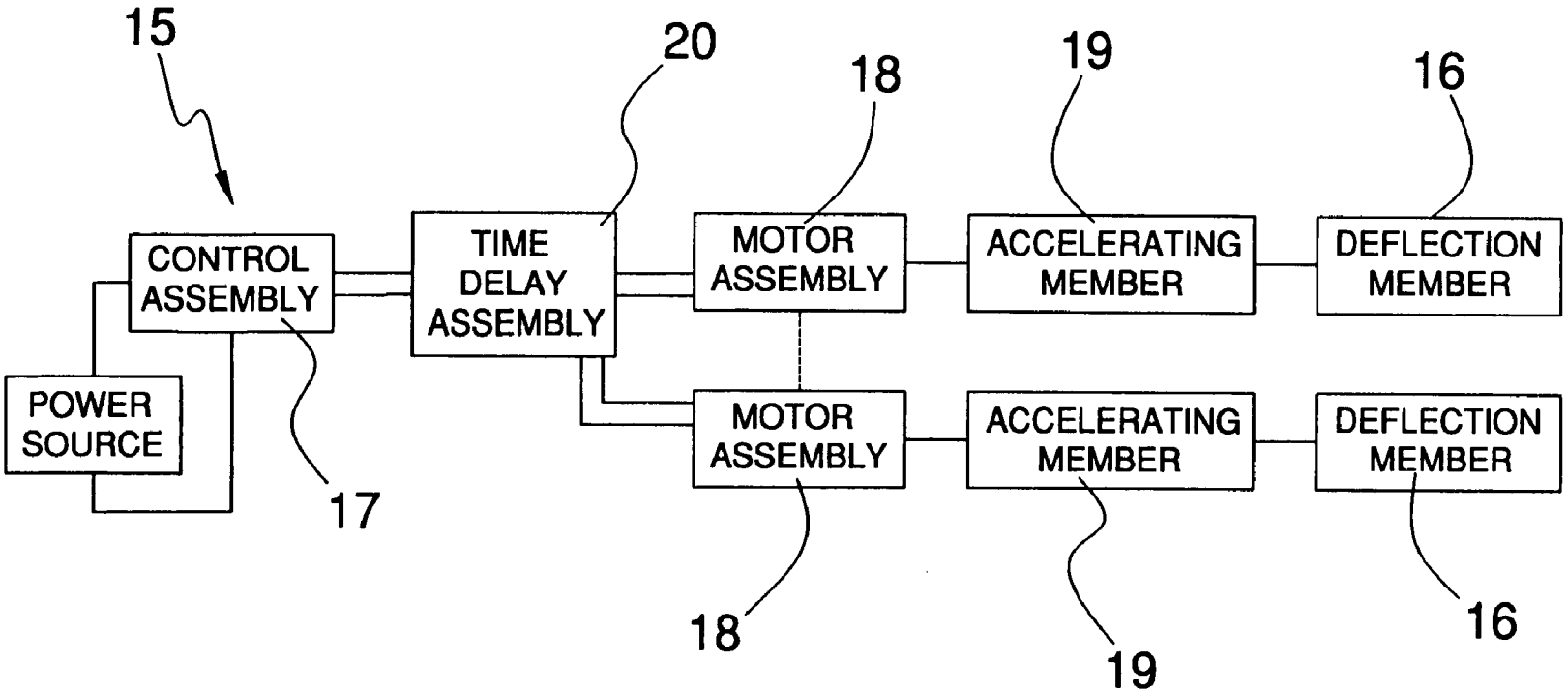
FIG. 8 is a schematic block diagram showing the operational relationship of the major components comprising the ball deflection assembly shown in FIGS. 1 and 2.

In an alternate embodiment, as shown in FIG. 4, the ball deflection assembly 15 has a ramp member 44. The ramp member 44 is selectively positionable in a raised position defined by the ramp member 44 angling upwardly from the top surface 12 of the lane member 11. The ramp member 44 is designed for vaulting the bowling ball into the pins when the ramp 44 is in the raised position and is struck by the bowling ball propelled down the lane member 11. The ramp member 44 is selectively positionable in a lowered position defined by the ramp member 44 being level with the top surface 12 of the lane member 11, designed for permitting the bowling ball to pass unimpeded.

In use, the user can stand at the end 32 of the lane member 11 opposite the pins and roll a ball down the lane member 11 towards the pins. The user can then use the control assembly 17 to selectively raise one of the panel members to redirect the bowling ball at the pins. The user can also use the propelling mechanism by loading a bowling ball into the housing 23 and drawing the saddle member 24 back. The user then places a foot on the foot support portion 34 and pivots the latching member 30 to release the bowling ball towards the pins.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A bowling lane system comprising:

a lane member having a top surface, said lane member having a pair of gutter portions extending a length of said lane member such that said gutter portions are positioned in opposing sides of said lane member, said top surface of said lane member being adapted for supporting a bowling ball and pins;

said lane member having a ball deflection assembly, said ball deflection assembly being adapted for deflecting the bowling ball towards the pins when the bowling ball is rolled along a top surface of said lane member;

a propulsion means being adapted for engaging the bowling ball such that said propulsion means is for propelling the bowling ball along the length of said lane member towards the pins when said propulsion means is actuated, said propulsion means being selectively positioned on a top surface of said lane member along a desired path;

wherein said propulsion means has a housing and a saddle member, said saddle member being positioned in said housing, said saddle member having a recessed area such that said recessed area is adapted for receiving the bowling ball, at least one biasing member being positioned between said housing and said saddle member such that said biasing member is adapted for propelling the bowling ball out of an open end of said housing; and wherein said housing of said propulsion means has a foot support portion, said foot support portion extending from a closed end of said housing opposite said open end of said housing, said foot support portion being adapted for receiving a foot of the bowler for inhibiting sliding of said housing when the bowline ball is propelled by said saddle member.

2. The bowling ball system as set forth in claim 1, wherein said ball deflection assembly comprises:

a plurality of deflection members, said deflection members being positioned in a spaced relationship across a width of said lane member, each of said deflection members being selectively positionable in a raised position defined by the associated one of said deflection members angling upwardly from said top surface of said lane member, each of said deflection members being adapted for redirecting the path of the bowling ball when associated one of said deflection members is in said raised position and is struck by the bowling ball propelled down the lane member, each of said deflection members being selectively positionable in a lowered position defined by the associated one of said deflection members being level with said top surface of said lane member adapted for permitting the bowling ball to pass unimpeded.

3. The bowling lane system as set forth in claim 2, wherein said ball deflecting assembly further comprises:

a ramp member, said ramp member being selectively positionable in a raised position defined by said ramp member angling upwardly from said top surface of said lane member, said ramp member being adapted for vaulting the bowling ball into said pins when said ramp is in said raised position and is struck by the bowling ball propelled down said lane member, said ramp member being selectively positionable in a lowered position defined by said ramp member being level with said top surface of said lane member for permitting the bowling ball to pass unimpeded; and a control assembly, said control assembly being operationally coupled to said ramp members such that said control assembly is for selectively raising at least one of said ramp members into said raised position for redirecting the path of the bowling ball.

4. The bowling ball assembly as set forth in claim 2, wherein said deflection members of said ball deflection assembly are positioned in a substantially triangular formation, said deflection members having a pair of apex members, each of said apex members being positioned farthest from said gutter portions and being positioned closest to the pins.

5. The bowling system as set forth in claim 3, wherein said ball deflection assembly further comprises:

a plurality of motor assemblies, each of said motor assemblies being operationally coupled between one of said deflection members and said control assembly such that each of said motor assemblies is for actuating the associated one of said deflection members between said raised position and said lowered position when said control assembly is actuated by the user.

6. The bowling lane system as set forth in claim 5, wherein said ball deflection assembly further comprises:

a plurality of accelerating members, each of said accelerating members being coupled to one of said deflection members, each of said accelerating members being for accelerating the raising of the associated one of said deflection members into said raised position when the associated one of said motor assemblies is actuated by the control assembly.

7. The bowling lane system as set forth in claim 5, wherein said ball deflection assembly further comprises:

a time delay assembly, said time delay assembly being operationally coupled between said control assembly and said motor assemblies, said time delay assembly being for actuating each of said motor assemblies into said lowered position after a predetermined amount of time has elapsed since the associated one of said deflection members was raised into said raised position.

8. The bowling assembly set forth in claim 1, wherein said ball deflection assembly further comprises:

a raised portion and a ramp portion, said raised portion being positioned on said top surface of said lane member such that an upper surface of said raised portion is positioned above said top surface of said lane member, said upper surface of said raised portion being adapted for supporting the pins, said ramp portion having an angled face extending from said top surface of said lane member to said upper surface of said raised portion such that said angled face is adapted for vaulting the bowling ball into the pins positioned on said upper surface of said raised portion.

9. The bowling lane system as set forth in claim 1, wherein said saddle member of said propulsion means has a handle portion, said handle portion of said saddle member extending through a slot in a top wall of said housing, said saddle member being adapted for being gripped in the hand of the bowler such that said handle portion permits the bowler to draw said saddle member into a cocked position prior to propelling the bowling ball down said lane member.

10. The bowling lane system as set forth in claim 9, wherein said propulsion means has a latching member, said latching member extending through said housing, said latching member being pivotally coupled to said housing such that said latching member selectively engages said saddle member in said cocked position for selectively preventing the bowling ball from being propelled down said lane member, said latching member being pivotal for releasing said saddle member when the bowling ball is to be propelled down the lane.

11. The bowling lane system as set forth in claim 9, wherein said latching member of said propulsion means having a pawl, said pawl being positioned at an end of said latching member such that said pawl selectively engages a locking channel of said saddle member when said saddle member is in said cocked position.

12. A bowling lane system comprising:

a lane member having a top surface, said lane member having a pair of gutter portions extending a length of said lane member such that said gutter portions are positioned in opposing sides of said lane member, said top surface of said lane member being adapted for supporting a bowling ball and pins;

said lane member including a ball deflection assembly, said ball deflection assembly being adapted for deflecting the bowling ball towards the pins when the bowling ball is rolled along a top surface of said lane member;

said ball deflection assembly including a plurality of deflection members, said deflection members being positioned in a spaced relationship across a width of said lane member, each of said deflection members being selectively positionable in a raised position defined by the associated one of said deflection members angling upwardly from said top surface of said lane member, each of said deflection members being adapted for redirecting the path of the bowling ball when associated one of said deflection members is in said raised position and is struck by the bowling ball propelled down the lane member, each of said deflection members being selectively positionable in a lowered position defined by the associated one of said deflection members being level with said top surface of said lane member adapted for permitting the bowling ball to pass unimpeded;

wherein said ball deflection assembly further comprises a ramp member, said ramp member being selectively positionable in a raised position defined by said ramp member angling upwardly from said top surface of said lane member, said ramp member being adapted for vaulting the bowling ball into said pins when said ramp is in said raised position and is struck by the bowling ball propelled down said lane member said ramp member being selectively positionable in a lowered position defined by said ramp member being level with said top surface of said lane member for permitting the bowling ball to pass unimpeded;

said ball deflecting assembly further including a control assembly, said control assembly being operationally coupled to said ramp members such that said control assembly is for selectively raising at least one of said ramp members into said raised position for redirecting the path of the bowling ball;

said deflection members of said ball deflection assembly being positioned in a substantially triangular formation, said deflection members having a pair of apex members, each of said apex members being positioned farthest from said gutter portions and being positioned closest to the pins;

said ball deflection assembly further including a plurality of motor assemblies, each of said motor assemblies being operationally coupled between one of said deflection members and said control assembly such that each of said motor assemblies is for actuating the associated one of said deflection members between said raised position and said lowered position when said control assembly is actuated by the user;

said ball deflection assembly further including a plurality of accelerating members, each of said accelerating members being coupled to one of said deflection members, each of said accelerating members being for accelerating the raising of the associated one of said deflection members into said raised position when the associated one of said motor assemblies is actuated by the control assembly;

said ball deflection assembly further including a time delay assembly, said time delay assembly being operationally coupled between said control assembly and said motor assemblies, said time delay assembly being for actuating each of said motor assemblies into said lowered position after a predetermined amount of time has elapsed since the associated one of said deflection members was raised into said raised position; and propulsion means being adapted for engaging the bowling ball such that said propulsion means is for propelling the bowling ball along the length of said lane member towards the pins when said propulsion means is actuated, said propulsion means being selectively positioned on a top surface of said lane member along a desired path;

said propulsion means including a housing and a saddle member, said saddle member being position in said housing, said saddle member having a recessed area such that said recessed area is adapted for receiving the bowling ball, at least one biasing member being positioned between said housing and said saddle member such that said biasing member is adapted for propelling the bowling ball out of an open end of said housing;

said saddle member of said propulsion means including a handle portion, said handle portion of said saddle member extending through a slot in a top wall of said housing, said saddle member being adapted for being gripped in the hand of the bowler such that said handle portion permits the bowler to draw said saddle member into a cocked position prior to propelling the bowling ball down said lane member;

said propulsion means further including a latching member, said latching member extending through said housing, said latching member being pivotally coupled to said housing such that said latching member selectively engages said saddle member in said cocked position for selectively preventing the bowling ball from being propelled down said lane member, said latching member being pivotal for releasing said saddle member when the bowling ball is to be propelled down the lane;

said latching member of said propulsion means including a pawl, said pawl being positioned at an end of said latching member such that said pawl selectively engages a locking channel of said saddle member when said saddle member is in said cocked position; and said housing of said propulsion means further including a foot support portion, said foot support portion extending from a closed end of said housing opposite said open end of said housing, said foot support portion being adapted for receiving a foot of the bowler for inhibiting sliding of said housing when the bowling ball is propelled by said saddle member.

* * * * *